US007905622B2

(12) United States Patent
Nielson et al.

(10) Patent No.: US 7,905,622 B2
(45) Date of Patent: Mar. 15, 2011

(54) TRAFFIC SAFETY CONE INCORPORATING A FLASHING LIGHT MODULE

(76) Inventors: Lewis A. Nielson, Murray, UT (US); George C. Hatsis, St. George, UT (US)

( * ) Notice: Subject to any disclaimer, the term of this patent is extended or adjusted under 35 U.S.C. 154(b) by 81 days.

(21) Appl. No.: 12/423,871

(22) Filed: Apr. 15, 2009

(65) Prior Publication Data

US 2010/0265699 A1 Oct. 21, 2010

(51) Int. Cl.
*B60Q 7/00* (2006.01)

(52) U.S. Cl. ..... 362/158; 362/183; 362/800; 362/276

(58) Field of Classification Search ..... 362/183, 362/800, 276

See application file for complete search history.

(56) References Cited

U.S. PATENT DOCUMENTS

| | | | | |
|---|---|---|---|---|
| D277,739 | S | 2/1985 | Grammas | |
| D315,874 | S | 4/1991 | DeCaro | |
| 5,269,251 | A | 12/1993 | Freeman | |
| 5,294,924 | A * | 3/1994 | Dydzyk | 340/908.1 |
| 5,577,824 | A * | 11/1996 | Wright | 340/908.1 |
| 5,754,124 | A * | 5/1998 | Daggett et al. | 340/908.1 |
| 5,755,174 | A * | 5/1998 | Freeman | 116/63 C |
| D411,810 | S | 7/1999 | Stockman | |
| 6,499,858 | B2 * | 12/2002 | Hart | 362/183 |
| 6,556,147 | B1 * | 4/2003 | Fisher et al. | 340/908 |
| 2003/0132852 | A1 * | 7/2003 | Povey et al. | 340/815.45 |

* cited by examiner

*Primary Examiner* — Anabel M Ton
(74) *Attorney, Agent, or Firm* — Angus C. Fox, III

(57) ABSTRACT

A traffic safety cone incorporating a flashing light module includes electrically coupled first and second modules. The first module includes a solar cell array positioned atop an upper surface of a circular mounting member, a resilient, impact cushioning bumper that surrounds the mounting member, and a high-intensity LED flasher unit having a cylindrical base. The circular disk is secured to the top of the flasher unit, and the cylindrical base fits into the top of a traffic cone that has been truncated for a precise fit. The second module includes a truncated cone-shaped housing, electrical batteries installed within the housing, battery charging circuitry and an ON/OFF switch. The second module and a module retainer plate, which also functions as a battery cover, are installed in that order in the bottom of the traffic safety cone and are secured to the first module with threaded securing rods.

20 Claims, 4 Drawing Sheets

TRAFFIC SAFETY CONE INCORPORATING A FLASHING LIGHT MODULE

FIELD OF THE INVENTION

This invention relates, generally, to traffic control systems and, more particularly, to a flashing light module which can be installed on the top of a conventional traffic-control cone.

BACKGROUND OF THE INVENTION

Marker cones have long been used as a substitute for paint-marked lanes in the temporary direction of traffic. Traffic cones are typically low-cost, brightly-colored, hollow, light-weight, stackable markers made of an elastomeric material so as to minimize damage to vehicles and the markers, themselves, when vehicles inadvertently collide with them. In order to enhance nighttime visibility of marker cones, numerous attempts have been made to equip the cones with various illumination devices.

For example, U.S. Pat. No. Des. 315,874, U.S. Pat. No. Des. 277,739 and U.S. Pat. No. Des. 411,810 all disclose traffic cones incorporating a flashing light.

U.S. Pat. No. 5,269,251 to Donald H. Freeman, discloses devices and methods for utilizing standard traffic cones to support standard information signs, standard flags and staffs, standard barricade rope and standard barricade tape, standard chemical light sticks, and battery operated warning lamps. A polyvinylchloride adapter has a first end that fits over the top of a standard traffic cone, and a second end that is adapted to serve as a connector for signs, flags, chemical light sticks, a battery-operated warning lamp, and barricade rope or tape.

U.S. Pat. No. 5,755,174, also issued to Donald H. Freeman, improves on the apparatus of his earlier patent by providing a system for securing warning lights, signs, and warning flags to the tops of standard traffic cones either with or without the use of adapters. A cable having a first end is secured to the warning light, sign or warning flag. A second end of the cable is looped and passes through a central aperture in a removable security disc, which has a diameter such that it can be inserted only part way into the cone from the bottom thereof. A padlock is used to secure the looped second end of the cable within the central aperture.

U.S. Pat. No. 6,499,858 to David Alan Hart discloses an illuminated base which can be placed beneath a translucent cone. The illuminated base may be powered by a variety of sources, including a solar panel.

While the above described devices and methods denote important and useful traffic control systems, they do not provide solutions to the problems associated with traffic safety control security systems addressed by the instant invention.

SUMMARY OF THE INVENTION

The present invention provides a battery-powered flashing light module for installation on a conventional traffic cone. Given that traffic cones are intended to be placed in positions where they are likely to be struck by vehicles from time to time, it is an object of the present invention to provide a flashing light module that is designed to minimize damage to the lighting components if the cone is struck, so that it can be repaired with minimal cost. An additional object of the present invention to minimize the likelihood that the unit will fragment if struck. It is a further object of the invention to position the battery packs within the cone so as to lower the center of gravity of the cone and light assembly so that it is less easily tipped over. It is yet another object of the present invention to provide an efficient solar recharging system for the flashing light module. It is still another object of the present invention to provide a design for which will enable light emitting diodes to be incorporated into the flashing light module in such a manner that at least several of the LEDs can be clearly seen from any direction within a 360-degree arc about the light module.

The present invention fulfills the objects heretofore set forth. A traffic safety cone incorporating a flashing light module includes electrically coupled first and second modules. A planar solar cell array is positioned on the top surface of a circular disk that is surrounded by a resilient annular bumper that cushions the impact when the cone is struck or knocked over. The solar cell array and resilient annular bumper are secured to the top of a high-intensity LED flasher unit. The top of a traffic cone is truncated so as to have a top aperture diameter to precisely fit the flasher unit. The first module, which sits atop the truncated traffic cone, includes the solar cell array, the donut-shaped bumper, and the high-intensity LED flasher unit. Power cells or batteries, which power the flasher unit, battery recharging circuitry, and an ON/OFF switch are positioned in a cone-shaped housing and, together, form a second module, that is installed within the traffic cone from the bottom thereof. A module retainer plate, which also serves as a battery cover, is placed beneath the second module, and the module retainer plate and the second module are both secured to a pair of downwardly projecting threaded studs on the flasher unit using a pair of attachment rods, each of which has a tightening knob at one end (that can be manipulated with the fingers) and a female-threaded opposite end. The first and second modules are electrically coupled with a cable that preferably extends from the first module and plugs into a socket in the second module. The first and second modules can be tightened together with the attachment rods so that both modules and the traffic cone are securely united as a single unit.

PREFERRED EMBODIMENT OF THE INVENTION

Figure 1:
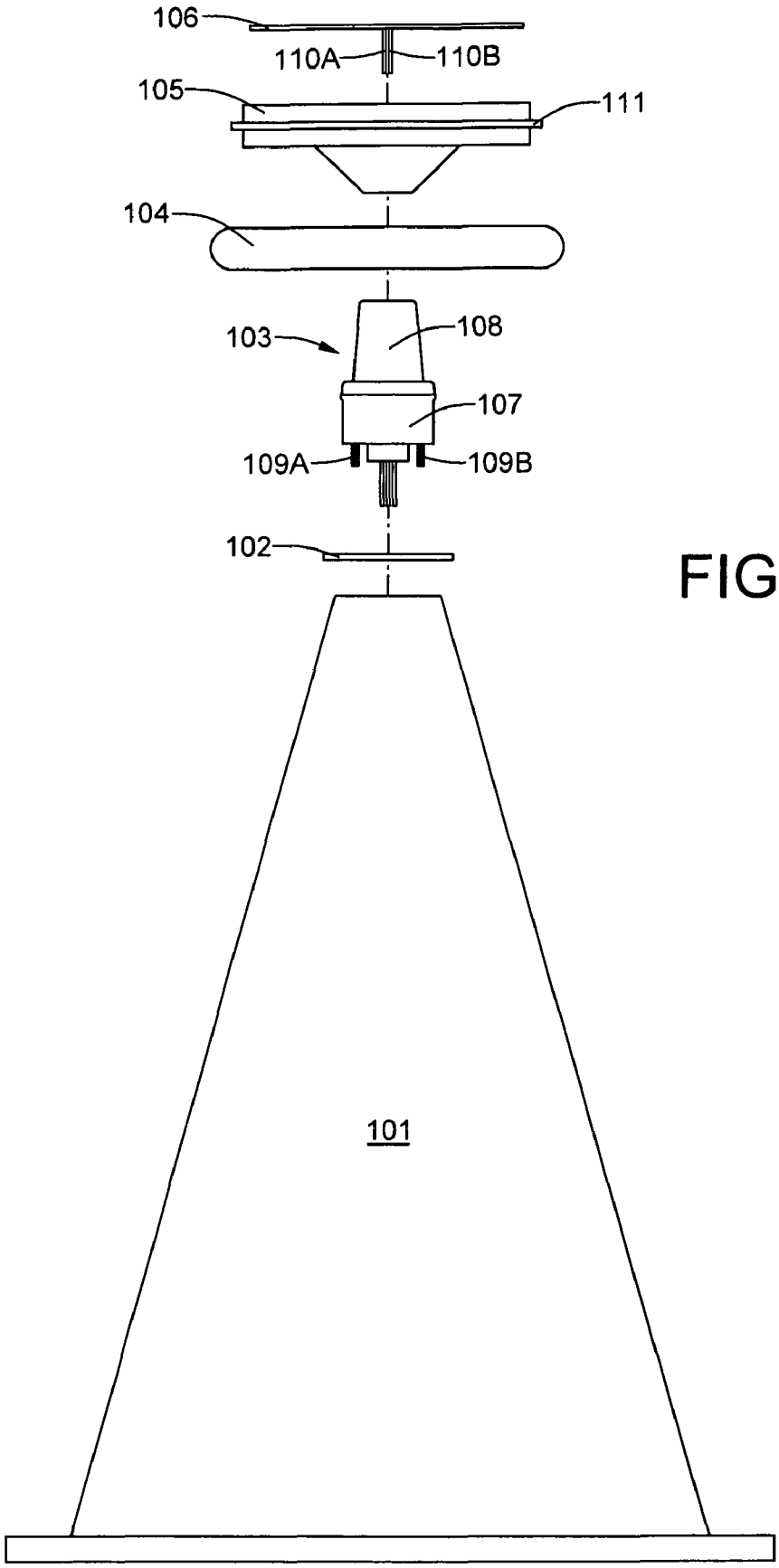
FIG. 1 is an elevational view of a standard traffic safety cone and an exploded first module.

The invention will now be described with reference to the attached drawing FIGS. 1 through 5. It should be understood that the drawing figures are not necessarily drawn to scale and are meant to be merely illustrative of the invention.

Referring now to FIG. 1, a traffic control cone incorporating a flashing light module includes a standard traffic control cone 101, a stop washer 102, a high-intensity LED flasher unit 103, a resilient annular bumper 104, a solar panel mounting platform 105, and a solar cell array 106. The high-intensity LED flasher unit 103 puts out sufficient candlepower in bright daylight that it cannot be ignored. A flasher unit of this type can be purchased from Ingram Products, Inc. Of Jacksonville, Fla. 32257. The specifications of the product can be found on Ingram Products' Internet website: www.ingramproducts.com. A preferred flasher is identified as SunBurst Model SB1224AD. This particular model operates on either 12 or 24 volts DC and draws 395 mA of current when in a steay-on state. Current draw is less than half that amount when operating in the flashing mode of 60 flashes per minute. The flashing circuitry is built into the two-inch diameter cylindrical base 107. The polycarbonate plastic lens 108 is available in red, amber, green or clear. An array of high-intensity LEDs is visible through the lens 108 about a full-circle arc of 360 degrees. For the present invention, the cautionary amber color lens is considered the preferred option. It will be noted that two threaded studs 109A and 109B protrude from the cylindrical base 107 of the flasher unit 103. As will be subsequently shown, these threaded studs will be used to secure the flasher unit to the cone 101. It will be noted that a pair of conductors 110A and 110B are coupled to the solar cell array 106. It will further be noted that the solar panel mounting platform 105 has a circumferential rim 111.

Figure 2:
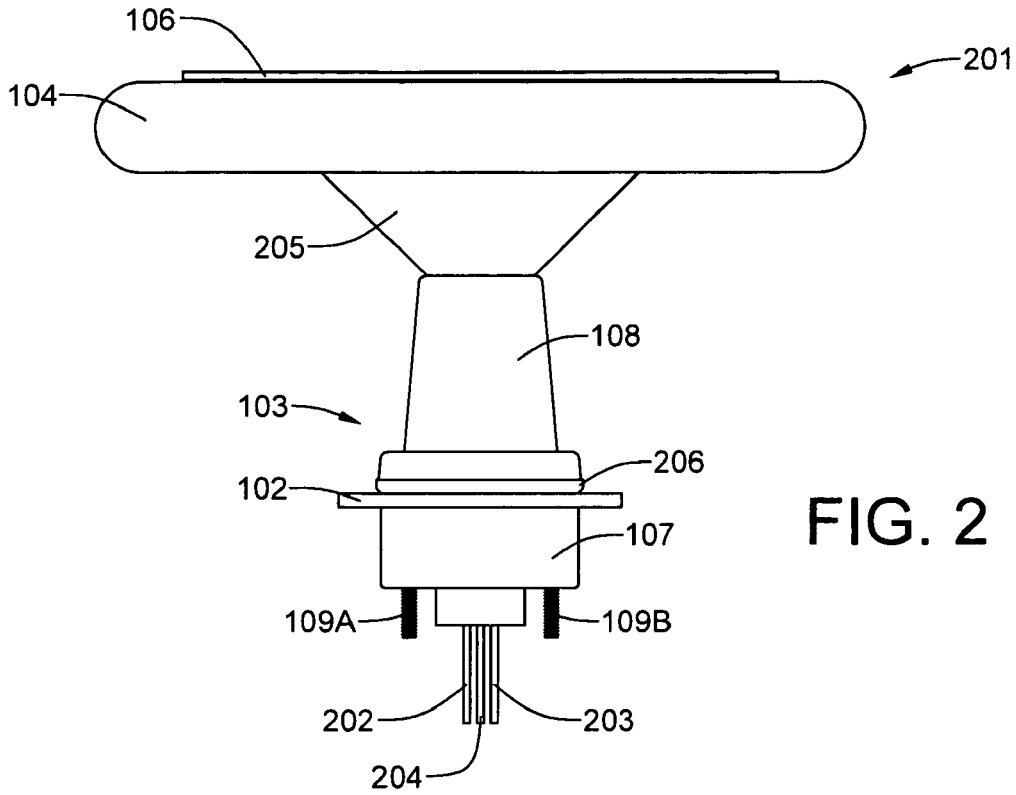
FIG. 2 is an elevational assembled view of the first module.

Referring now to FIG. 2, the stop washer 102, the a high-intensity LED flasher unit 103, the resilient annular bumper 104, the solar panel mounting platform 105, and a solar cell array 106 have been assembled into a single first module 201. The solar panel mounting platform 105 has been adhesively bonded to the top of the lens 108 of the flasher unit 103. It will be noted that three conductors exit the bottom of the cylindrical base 107. A brown conductor 202 and a center black common conductor 203 are connected to a 12-volt DC potential for flashing operation; a blue conductor 204 and the center black common conductor 203 are connected to a 12-volt DC potential for steady-on operation. The conductors 110A and 110B of the solar cell array 106 are rounted through a hole (not shown) drilled in the top of the lens 108 and are routed through the flasher unit 103 and through the bottom of the base 107, along with the flasher conductors 202, 203 and 204. The solar panel mounting platform 105 has a funnel shaped base 205 that elevates the platform above the lens so that it will minimize blockage of the lens from a driver's view. The horizontal mounting position provided by the solar mounting platform 105 is considered the optimum location for a solar cell array, as it ensures the most constant and most uniformly intense reception of light from the sun. It will be noted that the diameter of the circular aperture of the stop washer 102 is sized to ride against an annular ridge 206 of the base 107 when installed thereon.

Figure 3:
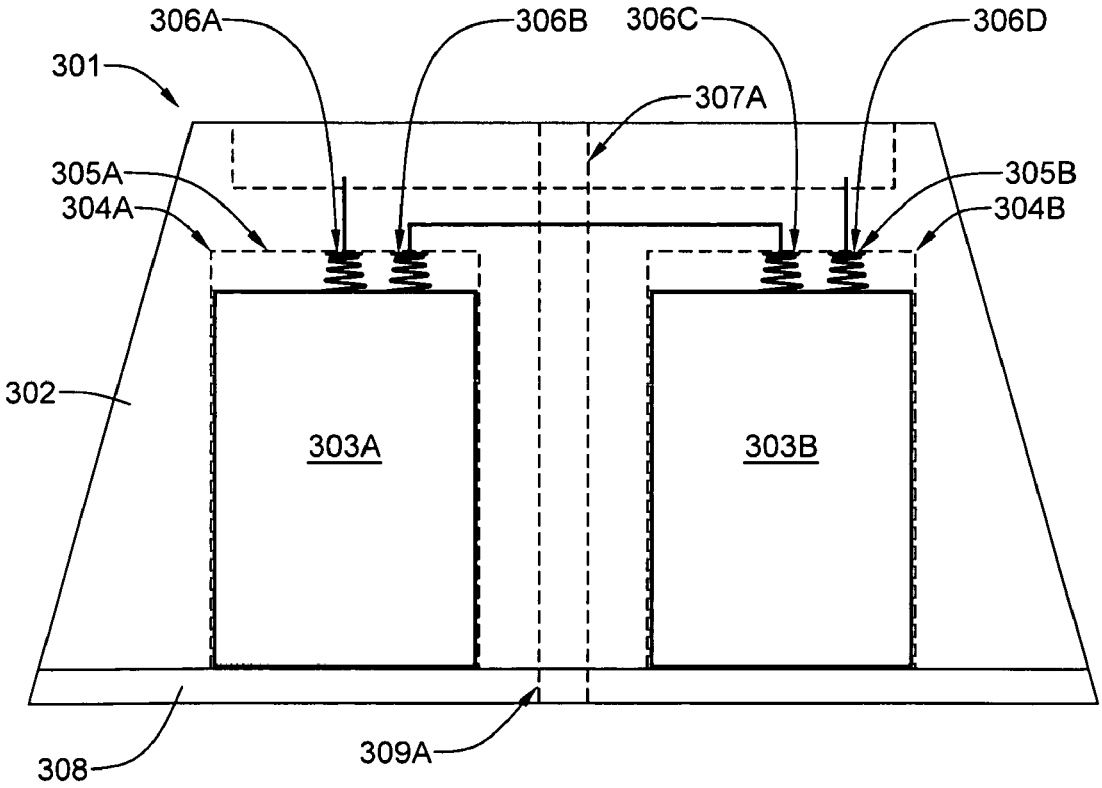
FIG. 3 is an elevational view of the second module.

Referring now to FIG. 3, a second module 301 designed for installation within the traffic control cone 101. The second module 301 includes a truncated cone-shaped, or frustrum-shaped housing 302, a pair of rechargeable 6-volt batteries 303A and 303B, each of which is installed within a recess 304A and 304B, respectively, in the housing 302. It will be noted that the frustrum-shaped housing 302 has a lower base with a diameter less than that of said larger lower opening at the base of the truncated safety cone 101, and an upper base with a diameter greater than that of the upper opening of the truncated safety cone 101. The ceiling of each recess 305A and 305B, respectively, incorporates a pair of battery terminal contact plates 306A, 306B, 306C and 306D. It will be noted that contact plates 306B and 306C are tied together to couple the two batteries 303A and 303B in series in order to provide a nominal output of 12-volt DC. A tray at the top of the housing 302, provides a mounting location for battery recharging and regulation circuitry. It will be noted that there a pair of cylindrical apertures 307A and 307B are formed in the housing 302, only one of which (307A) is visible in this hidden view. If the housing were axially rotated 90 degrees, both would then be visible in a hidden view format. It will be noted that a module retainer plate 308, which also functions as a battery cover, is installed beneath the housing 302. It is equipped with apertures 309A and 309B (only 309A is visible as a hidden item in this view), which align with cylindrical apertures 307A and 307B, respectively. It should be clear that the 6-volt batteries 303A and 303B could be replaced with eight individual rechargeable electro-chemical cells, or power units, each of which has a nominal voltage of 1.5 volts.

Figure 4:
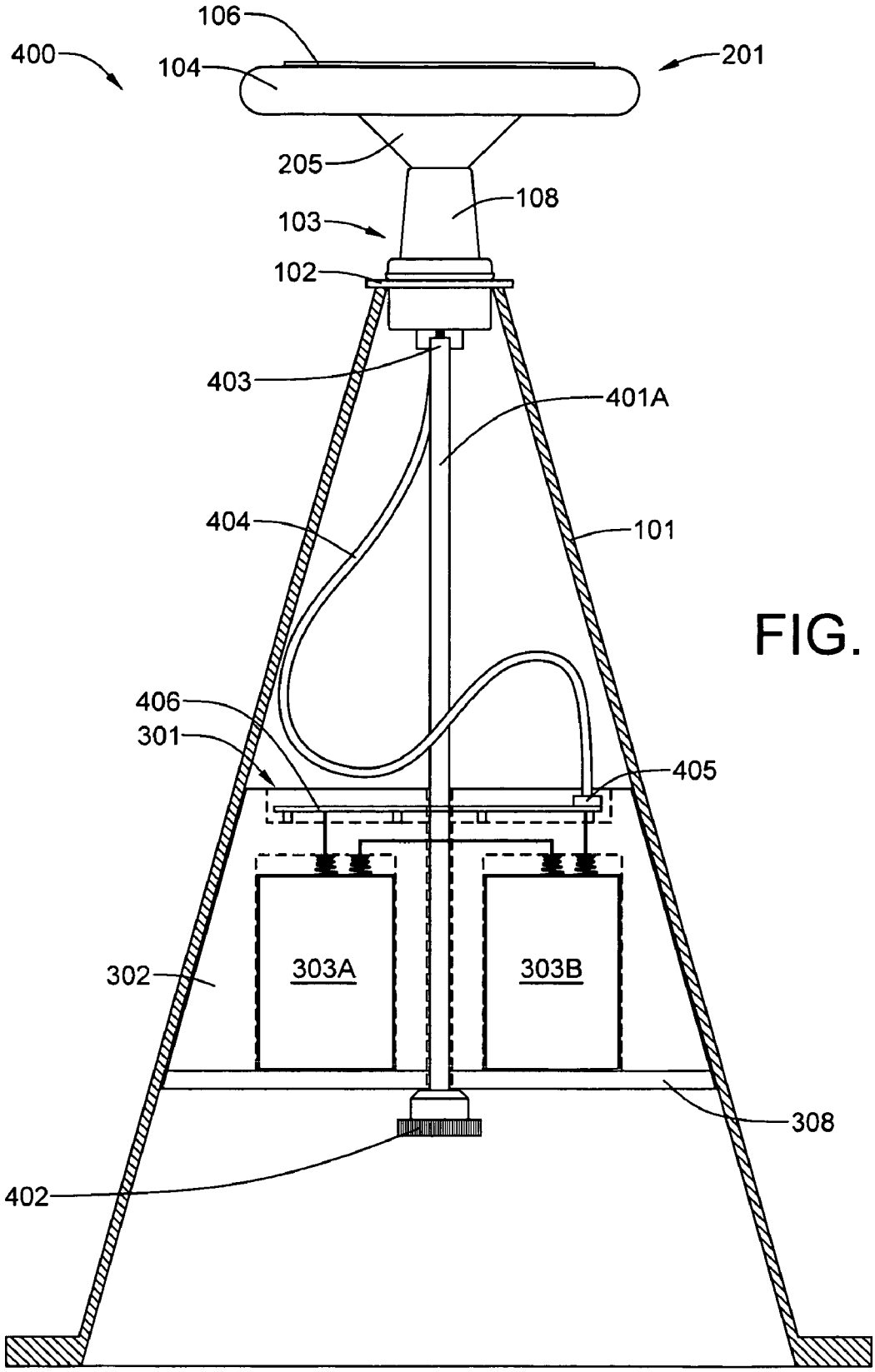
FIG. 4 is an elevational cut-away view of the traffic safety cone, having first and second modules secured thereto with the attachment rods.

Referring now to FIG. 4, the traffic safety cone unit 400, which incorporates a flashing light module 103 is shown in a fully-assembled, cut-away view. It will be noted that the second module 301 is secured to the threaded studs 109A and 109B of the first module 201 with a pair of attachment rods 401A and 401B (only 401A is visible as a hidden item in this view). Each attachment rod is equipped with a tightening knob 402 at one end (that can be manipulated with the fingers) and a female-threaded opposite end 403. It will be noted that the first module 201 is electrically coupled to the second module 301 via a multi-conductor connector cable 404, which plugs into a socket 405 in the circuit board 406 containing the battery recharging and regulation circuitry.

Figure 5:
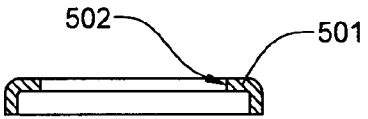
FIG. 5 is a cross-sectional view of a second embodiment stop washer having a cupped configuration, taken through the washer's central axis.

Referring now to FIG. 5, a second embodiment of the stop washer 102 is shown. This second embodiment washer 501 is cup shaped to prevent the entry of water into the cone when used in inclement conditions. The seal can be improved by hermetically sealing the joint where the washer 501 makes contact with the annular ridge 206. The aperture 502 of the second embodiment stop washer 501 can be seen in this cross-sectional view.

Figure 6:
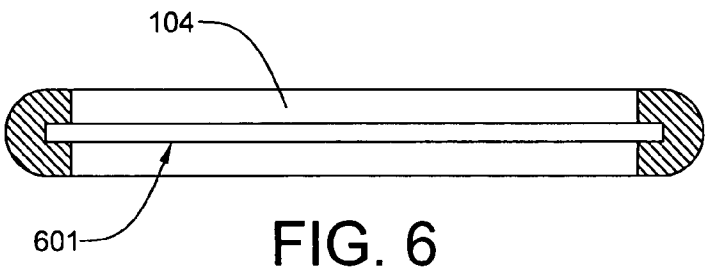
FIG. 6 is a cross-sectional view of the resilient annular bumper.

Referring now to FIG. 6, in this cross-sectional view of the resilient annular bumper 104, it can be clearly seen how the inner groove 601 can fit over the circumferential rim 111 of the solar panel mounting platform 105.

Figure 7:
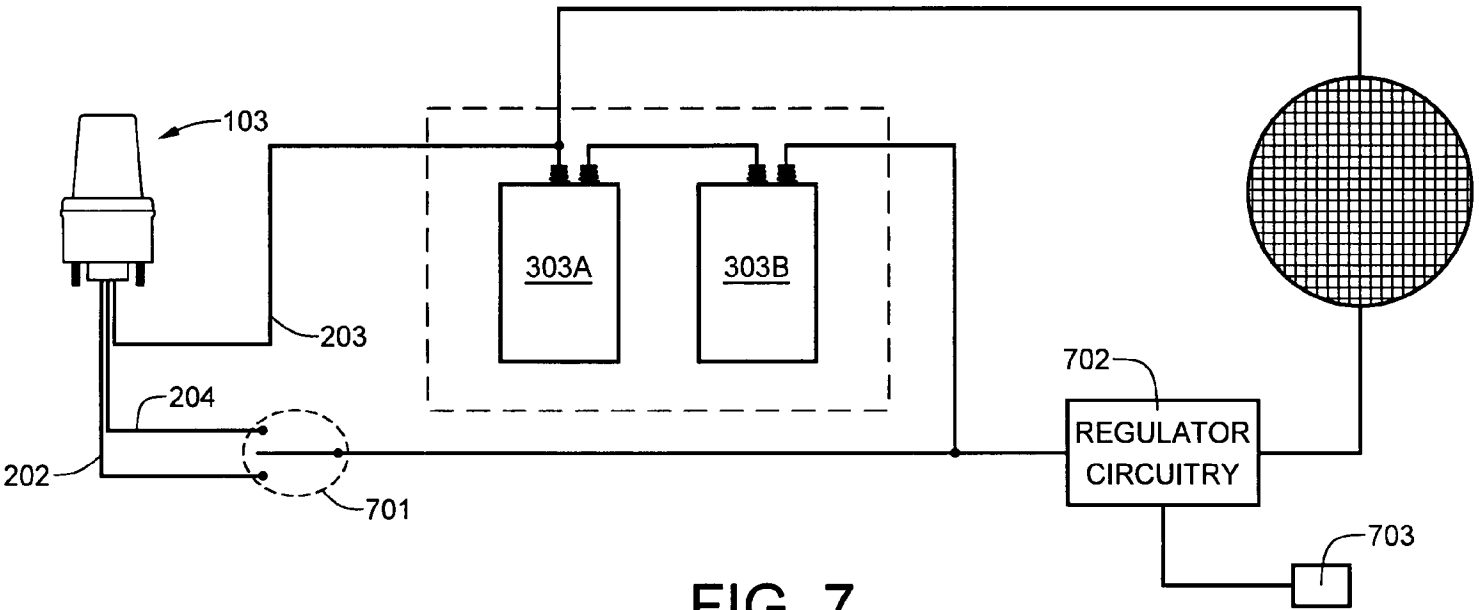
FIG. 7 is a block diagram of the electrical circuitry of the traffic safety cone incorporating a high-intensity flasher unit.

Referring now to the electrical block diagram of FIG. 7, the high-intensity flasher unit 103 is coupled to the series-connected rechargeable 6-volt batteries 303A and 303B through three-position switch 701. The three positions of the switch are flashing on, steady on and off. The solar cell array panel 106 is coupled to the batteries 303A and 303B through regulator circuitry 702. A recharge jack 703 provides a means to charge the batteries 303A and 303B using an external low-voltage DC source. The three-position switch 701 and the recharge jack 703 may be positioned in a variety of convenient locations on the unit 400.

It should be clear that there are several significant advantages to having interconnected first and second modules 201 and 301. The first significant advantage is a much lower center of gravity that would be possible if the batteries, in particular, were installed in a single unit on top of the traffic control cone 101. Thus, the batteries 303A and 303B act as ballast having a low center of gravity for the truncated traffic safety cone. A second advantage is that by securing the second module 301 to the first module 201, both modules are secured to the traffic control cone 101. This feature lessens the likelihood that components of the unit 400 will be scatted on the roadway if the cone 400 is inadvertently or intentionally struck by a moving vehicle. A further advantage is that by placing components that need not be visible within the cone, itself, those hidden components are afforded greater protection from damage in the event the unit 400 is struck by a vehicle. In addition, by placing the batteries 303A and 303B within the cone, much higher capacity batteries can be used than would be possible if the batteries were placed in a single module mounted atop the cone 101.

Although only a single embodiment of the traffic safety cone incorporating a flashing light module is shown and described herein, it will be obvious to those having ordinary skill in the art that changes and modifications may be made thereto without departing from the scope and the spirit of the invention as hereinafter claimed.

What is claimed is:

1. An illuminated traffic control device comprising:

a truncated traffic safety cone having a first upper opening and a larger second lower opening at its base;

a first module having a cylindrical base installed within said first upper opening, and an upper portion containing a high-intensity LED light unit;

a second module having a frustrum-shaped housing, with electro-chemical power units for powering the LED light unit installed therein, said frustrum-shaped housing having a lower base with a diameter less than that of said larger second lower opening and an upper base with a diameter greater than that of said first upper opening, said second module installed within said safety cone through the larger second opening;

a multi-conductor cable, which electrically couples the first and second modules; and at least one threaded fastener which secures said second module to said first module, thereby securing both modules and both modules to the truncated traffic safety cone.

2. The illuminated traffic control device of claim 1, wherein said high-intensity LED light unit has both a steady-on mode and a flashing mode.

3. The illuminated traffic control device of claim 1, wherein said truncated traffic safety cone is trimmed to receive the cylindrical base of the LED light unit.

4. The illuminated traffic control device of claim 3, wherein said generally cylindrical base is equipped with an annular ridge, and said illuminated traffic safety cone further comprises a stop washer having a circular aperture sized to ride against the annular ridge and, thereby, prevent the high-intensity LED light unit from slipping into the first upper opening of the truncated traffic safety cone.

5. The illuminated traffic control device of claim 1, wherein said electro-chemical power units include a pair of rechargeable batteries, each of which has a nominal DC output of 6 volts, said batteries not only providing power for the high-intensity LED light unit, but also provide ballast for the truncated traffic safety cone with a center of gravity that is substantially below the upper opening thereof.

6. The illuminated traffic control device of claim 5, wherein said batteries are installed within separate recesses formed within the frustrum-shaped housing, each battery has a pair of resilient, spaced-apart contacts on a top portion thereof, and each recess has a ceiling equipped with a pair of battery terminal contact plates through which power is taken from the battery located within that recess.

7. The illuminated traffic control device of claim 6, wherein the batteries are series coupled to provide a power supply having a nominal DC output of 12-volts.

8. The illuminated traffic control device of claim 4, wherein said stop washer is cup shaped and a joint where the washer makes contact with the annular ridge is hermetically sealed to prevent entry of water into the interior space of the truncated traffic safety cone.

9. The illuminated traffic control device of claim 1, which further comprises:

a solar panel mounting platform mounted atop said high-intensity LED light unit;

a solar cell array panel mounted atop said solar panel mounting platform; and recharging circuitry coupling said solar cell array panel to said electro-chemical power units, said recharging circuitry mounted on said housing.

10. The illuminated traffic control device of claim 9, which further comprises a resilient annular bumper, which fits around said solar panel mounting platform and protects the first module from damage in the event that the illuminated traffic control device is tipped over.

11. An illuminated traffic control device comprising:

a truncated traffic safety cone having a first upper opening and a larger second lower opening at its base;

a first module installed within said upper opening, said first module including:

a high-intensity LED light unit having a generally cylindrical base, flasher circuitry installed in the base, a lens sealably secured to said base, and an array of high-intensity LEDs visible through the lens, and providing 360 degrees of visibility;

a solar panel mounting platform secured to a top portion of said high-intensity LED light unit; and a solar cell array panel secured to said solar panel mounting platform; mounted atop the LED light unit installed in the first upper opening;

a second module installed within said truncated traffic safety cone through said lower opening, said second module including:

a truncated cone-shaped housing;

electro-chemical power units installed within recesses in the housing; and charging circuitry coupled to the electro-chemical power units, and mounted on the housing;

a multi-conductor cable, which electrically couples the solar cell array panel to the charging circuitry and the LED light unit to the electro-chemical power units; and means for securing said first module to said second module and both modules to said truncated traffic safety cone.

12. The illuminated traffic control device of claim 11, wherein said means for securing comprises a pair of attachment rods, each of which has a finger tightenable head at one end thereof and a female-threaded opposite end, each of said attachment rods passing through one of a pair of cylindrical apertures in said truncated cone-shaped housing so that the female-threaded opposite end of each attachment rod can engage one of two threaded studs which downwardly project from said base.

13. The illuminated traffic control device of claim 11, wherein said high-intensity LED light unit has both a steady-on mode and a flashing mode.

14. The illuminated traffic control device of claim 11, wherein said truncated traffic safety cone is trimmed to receive the cylindrical base of the LED light unit with a slip fit having minimal clearance.

15. The illuminated traffic control device of claim 11, wherein said generally cylindrical base is equipped with an annular ridge, and said illuminated traffic safety cone further comprises a stop washer having an a circular aperture sized to ride against the annular ridge and, thereby, prevent the high-intensity LED light unit from slipping into the first upper opening of the truncated traffic safety cone.

16. The illuminated traffic control device of claim 12, wherein said electro-chemical power units are a pair of series-coupled rechargeable batteries, each of which has a nominal DC output of 6-volts, which not only power the high-intensity LED light unit, but provide ballast for the truncated traffic safety cone with a center of gravity that is substantially below the upper opening thereof.

17. The illuminated traffic control device of claim 16, wherein said batteries are installed within separate recesses formed within the truncated cone-shaped housing, each battery has a pair of resilient, spaced-apart contacts on a top portion thereof, and each recess has a ceiling equipped with a pair of battery terminal contact plates through which power is taken from the battery located within that recess, said recesses being covered by a module retainer plate that is installed beneath the housing, said retainer plate having a pair of apertures that align with the cylindrical apertures in said housing, and through which said attachment rods also pass.

18. The illuminated traffic control device of claim 15, wherein said stop washer is cup shaped and a joint where the washer makes contact with the annular ridge is hermetically sealed to limit the entry of water into the interior space of the truncated traffic safety cone when the device is exposed to inclement weather.

19. The illuminated traffic control device of claim 11, which further comprises a resilient annular bumper, which fits around said solar panel mounting platform and protects the first module from damage in the event that the illuminated traffic control device is tipped over.

20. The illuminated traffic control device of claim 11, which further comprises a jack coupled to said charging circuitry, which enables recharging of the electro-chemical power units from an external DC source.

* * * * *